US005388490A

United States Patent [19]

Buck

[11] Patent Number: 5,388,490

[45] Date of Patent: Feb. 14, 1995

[54] ROTARY DIE CUTTING SYSTEM AND METHOD FOR SHEET MATERIAL

[76] Inventor: Byron L. Buck, 7412 Via Lorado, Rancho Palos Verdes, Calif. 90274

[21] Appl. No.: 999,565

[22] Filed: Dec. 30, 1992

Related U.S. Application Data

[63] Continuation of Ser. No. 522,267, May 10, 1990, abandoned.

[51] Int. Cl.[6] ..... B26D 1/56; B26D 3/08

[52] U.S. Cl. ..... 83/880; 83/344; 83/887

[58] Field of Search ..... 83/13, 37, 881, 887, 83/344, 346, 347, 348, 699, 700, 880

[56] References Cited

U.S. PATENT DOCUMENTS

| | | | |
|---|---|---|---|
| 1,517,582 | 12/1924 | Rahr . | |
| 1,636,267 | 7/1927 | Williams . | |
| 1,723,660 | 8/1929 | Ross . | |
| 2,081,583 | 5/1937 | Fitchett . | |
| 2,106,866 | 2/1938 | Best . | |
| 2,776,607 | 1/1957 | Fischer et al. . | |
| 3,142,233 | 7/1964 | Downie . | |
| 3,162,070 | 12/1964 | Morgan et al. . | |
| 3,170,342 | 2/1965 | Downie | 76/107 |
| 3,197,991 | 8/1965 | Radamaker | 72/198 |
| 3,224,309 | 12/1965 | Nash | 83/156 |
| 3,244,335 | 4/1966 | Downie | 225/1 |
| 3,448,684 | 6/1969 | Cardinet et al. . | |
| 3,491,641 | 1/1970 | Vandenberg | 83/346 |
| 3,541,909 | 11/1970 | Franzen | 83/588 |
| 3,542,993 | 11/1970 | Buck . | |
| 3,599,463 | 8/1971 | Sennstrom et al. | 72/108 |
| 3,826,165 | 7/1974 | Currie et al. | 83/110 |
| 3,890,481 | 6/1975 | Buck . | |
| 3,962,557 | 6/1976 | Buck . | |
| 4,090,433 | 5/1978 | Jardine et al. . | |
| 4,095,498 | 6/1978 | Biggar, III | 83/346 |
| 4,205,596 | 6/1980 | Chesnut | 83/344 X |
| 4,226,150 | 10/1980 | Reed | 83/346 |
| 4,355,554 | 10/1982 | Gregory, III | 83/37 |
| 4,359,919 | 11/1982 | Fuchs et al. | 83/349 |
| 4,452,116 | 6/1984 | Kesten | 83/346 |
| 4,507,996 | 4/1985 | Kesten | 83/344 |
| 4,517,873 | 5/1985 | Wilson | 83/881 |
| 4,553,461 | 11/1985 | Belongia | 83/344 |
| 4,759,247 | 7/1988 | Bell et al. | 83/346 |
| 4,926,666 | 5/1990 | Gotting et al. | 72/247 |

FOREIGN PATENT DOCUMENTS

| | | |
|---|---|---|
| 0234559 | 9/1987 | European Pat. Off. . |
| 0305904 | 3/1989 | European Pat. Off. . |
| 0319894 | 6/1989 | European Pat. Off. . |
| 1461220 | 3/1969 | Germany . |
| 2750530 | 5/1979 | Germany . |
| 248791 | 6/1926 | Italy . |
| 2045144 | 10/1980 | United Kingdom . |

*Primary Examiner*—Eugenia Jones

*Attorney, Agent, or Firm*—Merchant, Gould, Smith, Edell, Welter & Schmidt

[57] ABSTRACT

A rotary sheet processing system, such as a roller die cutting system incorporates force transferring bearer surfaces which may be bidirectionally adjusted to vary the clearance between cutting elements and a backup anvil. Angled bearer surfaces together with means for dynamically adjusting relative lateral position of the bearer surfaces provide a geometrical clearance adjustment. Compression adjustments measurable by electrical means are used in interrelated fashion to the geometrical clearance, to hold preloading forces between minimum and maximum acceptable levels while assuring cutting of the sheet in the predetermined pattern.

1 Claim, 7 Drawing Sheets

FIG. 4
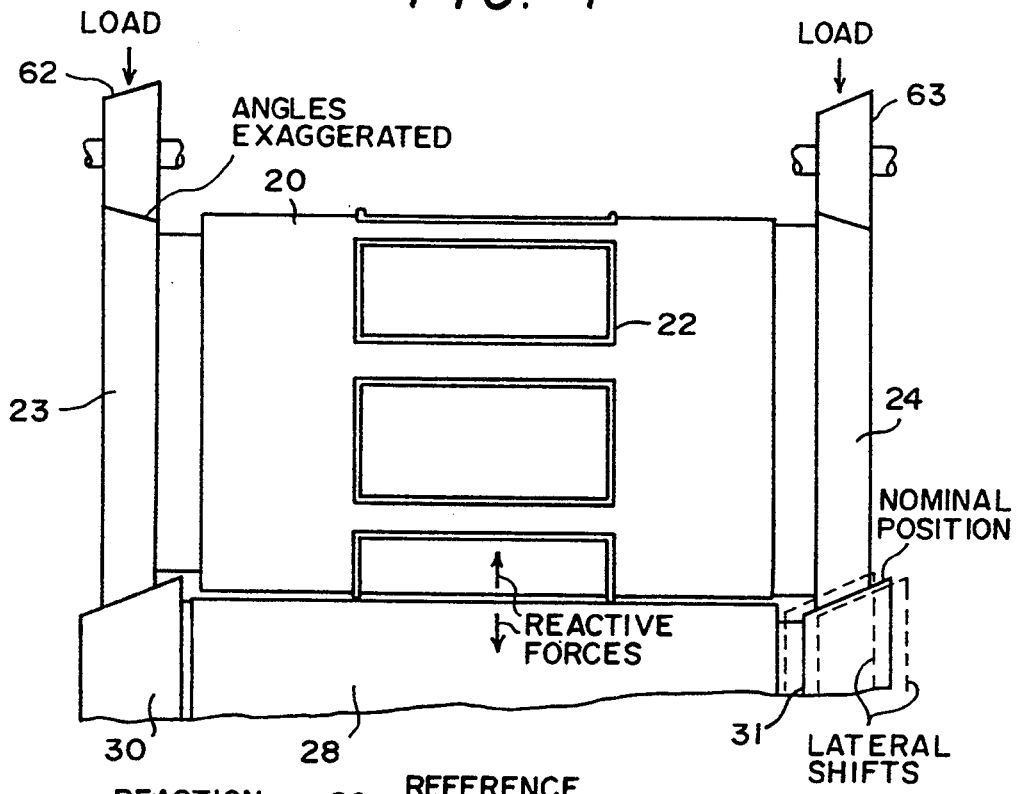
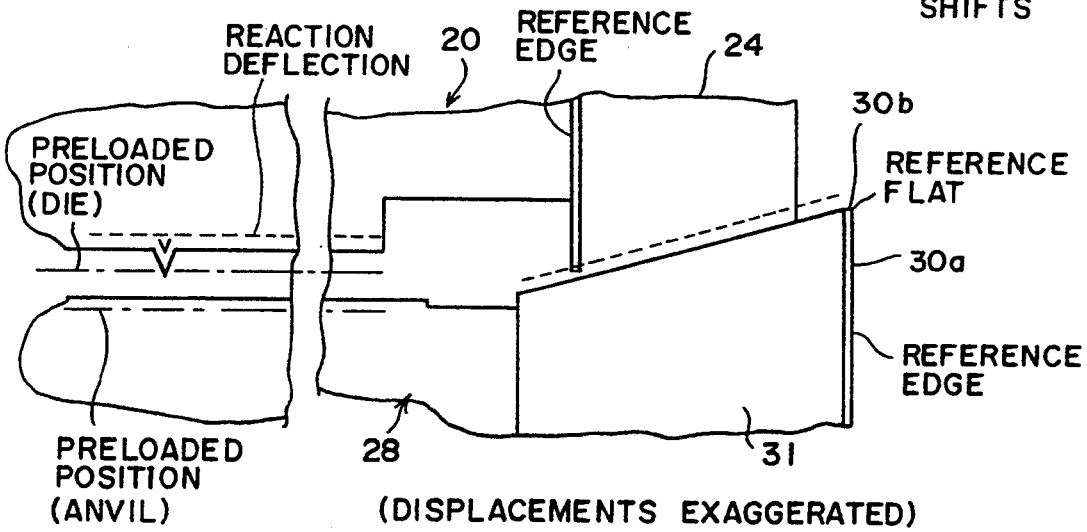
FIG. 8

FIG. 11
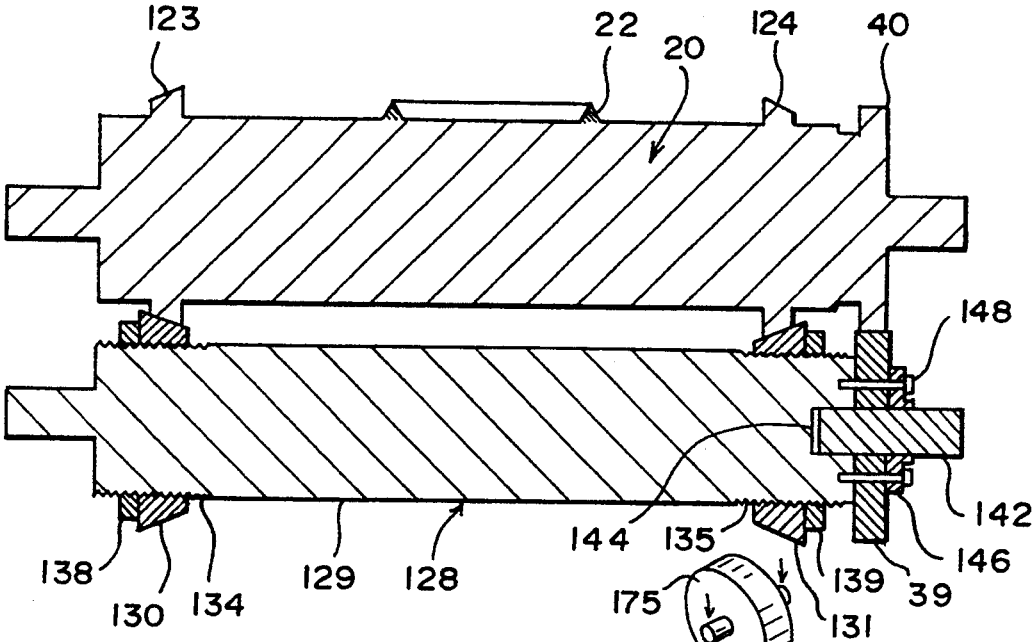
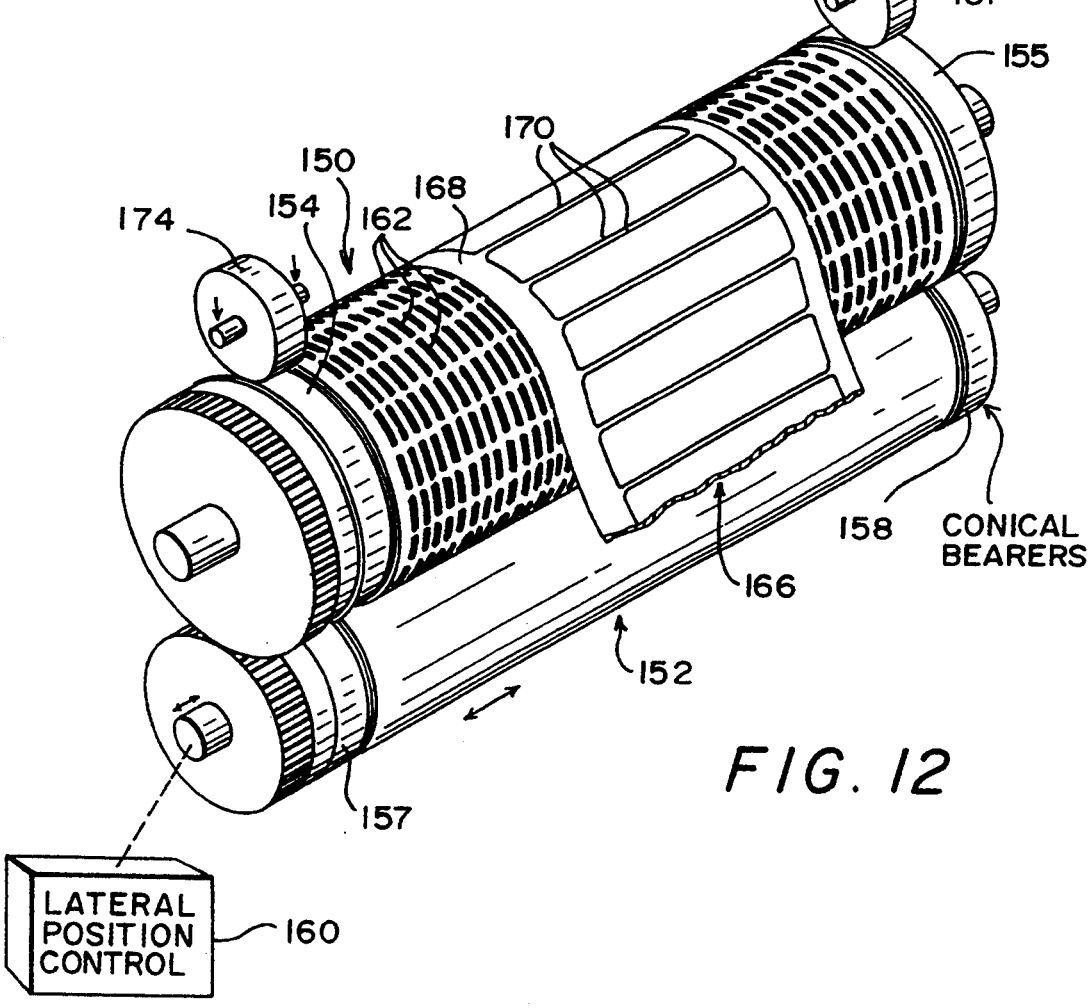
FIG. 12

ROTARY DIE CUTTING SYSTEM AND METHOD FOR SHEET MATERIAL

This is a continuation of application Ser. No. 07/522,267, filed May 10, 1990, now abandoned.

BACKGROUND OF THE INVENTION

This invention relates to systems and methods for processing sheet material passing between operative rollers, and more particularly to rotary die systems for cutting repetitive shapes from sheet material.

A rotary or roller die cutting system is typically a part of what is called a rotary press structure, a number of versions of which are widely available. The roller die itself is a quite rigid body of cylindrical form having a cutting blade of a predetermined areal pattern that protrudes outwardly to a selected distance from the cylindrical circumference. The tip of the blade contacts or is separated by a small gap from an adjacent anvil or back-up member that also rotates. Sheet material, typically in the form of a substantially continuous strip, passing between the roller die and the anvil is thus intended to be cut into the pattern defined by the blade. The rotary press includes means for driving the roller die and anvil synchronously, an ostensibly stable restraint system which includes end bearing blocks, and means for feeding and tensioning the sheet material. The term "sheet material" as used herein is intended to encompass continuous and discontinuous stock, such as the different webs, strips and bands used in die cutting operations, whether they are in single or multiple layers, and also whether they are of paper, plastic or other materials.

When the sheet material is to be cut entirely through, this is called "zero tolerance" cutting and the blade tip must lightly contact or be very slightly spaced from the anvil. It is more commonly the case that only an adhesive backed surface layer on a laminate is to be cut, with the underlying substrate remaining uncut. This is referred to as "kiss cutting" and is the basis for making the adhesive backed peel-off labels and shapes which are very widely employed in the labeling and packaging industries.

The term "cutting" is not accurately descriptive, because the penetration of the cutting blade into the sheet introduces localized shear forces that locally strain and deform the material, while the blade is also compressing it against the anvil. These actions cause the sheet to separate along the line of the blade even though the blade edge has not penetrated fully through the given layer. The cut may be said to be made by "bursting" the uncontacted thickness of the sheet under the highly concentrated forces that are applied. Such shearing and bursting actions must be very precise, because the cutting effect on a particular sheet or laminate is dependent, to a first approximation, on the shape of the blade, its spacing relative to the anvil, and on the thickness, strength and elasticity of the material. There are also dynamic and static factors at play that affect the result, as described in more detail hereafter. Most of the sheet materials used are in the range of a few hundredths of an inch to a few ten thousandths of an inch in thickness. In practice it is usually found that the needed spacing (or "clearance") between the tip of the cutting blade and the surface of the anvil for proper cut or bursting must be maintained to within a few tenths of a thousandth (such as 0.0001 to 0.0005 inches). This precision must be maintained under actual operating conditions which involve wear, high reactive forces and dynamic changes.

In order to attempt to meet these requirements, roller die systems and rotary presses currently incorporate a number of features. The roller die and anvil are precisely formed, hardened cylindrical bodies, and the cutting blades are usually hard, precision finished at the tips, and, at least initially, of uniform height and blade profiles. The ends of the roller die and anvil are set in bearing blocks that provide some restraint. In modern practice, however, the roller die and anvil also include bearing surfaces, called "bearers", at or near the extremities of their cylindrical bodies. The bearers on the die are in contact with the anvil, and the anvil often is supported on the opposite side from the roller die by a back-up support roller. The designer selects the radial dimensions of the bearers on the roller die and anvil for a given application, to provide a chosen nominal blade-anvil clearance for the material that is to be cut. If the spacing conditions are not correct a different anvil body having a different diameter may be substituted. This changes the nominal clearance but usually does not overcome other problems, as discussed further below. Substituting a new roller die must be avoided if at all possible because of the expenses involved in die fabrication.

The principal mode of control of the clearance is by the use of preloading or compressive forces acting on the journals or bearers. The die cutting module in the press thus includes a pressure bar that spans the length of the roller die, parallel to its axis, and supports a force exerting mechanism, such as adjustable loading screws. This mechanism displaces pressure rollers down onto the roller die (typically the top surface of the bearers), compressing the die bearers against the opposing surfaces on the anvil. The forces exerted are ultimately absorbed by the bearing blocks, back-up support roller if any, and the relatively massive frame of the rotary press. Compression of the bearers displaces the blade tip of the roller die slightly but measurably, and reduces the clearance by a determinable amount.

Experience in the die cutting field has shown quite conclusively that the bearer feature is essential for satisfying the rigorous requirements imposed on modern die cutting systems. Installations without bearers have been shown to be largely unable to control depth of cut with the precision needed. Thus preservation of the bearer function is of paramount importance to improved systems for die cutting applications.

A further advantageous technique, introduced by the present applicant relative to the bearer system, involves the insertion of load cells in the loading screw-pressure roller system, to provide electrical signals via associated circuitry. The signals are used for analog or digital indications, and for actuating recording instruments. By these means the compressive forces can be equalized, and operating conditions can be monitored as they change.

Anvils and roller dies are typically of sizes such as six, twelve or sixteen inches in circumference. While one obtains greater stability with larger roller dies, the costs of the larger rotary elements place practical limits on use of this alternative. Moreover, the roller die cutting process is a dynamic one which involves many operative variables that are not at first apparent, and some variables which are so complex that they are not fully understood. There are times when materials cannot be cut satisfactorily without extensive trial and error, and this can be economically disastrous, particularly if dies and anvil have to be modified or substituted.

The dynamics of a die cutting process vary, for example, in accordance with the configuration of the cutting blade. The blade typically (but not necessarily) forms a closed loop pattern having vectorial components which vary at any angle between a direction parallel to the longitudinal axis of the roller die (the "cross cut" direction) and along a circumference of the roller die (the "machine" direction). Thus there will often be significant differences in the length of cutting blade that is in contact with the sheet material at any instant during a cycle. A long line contact in the cross cut direction introduces much higher reactive forces than the one or two contact points that exist when the blade segments are in the machine direction. Forces of reaction against the roller die and anvil can thus differ by many orders of magnitude primarily because of these variations in blade disposition. The forces exerted at any time are also dependent on a number of other factors, such as the sharpness and shape of the cutting blade, and the thickness and stiffness of the material. The reactive forces created can be so high in fact that in some instances they induce discernible bouncing of the roller die in synchronism with the rotation. Such factors reflect the great amount of "work" that must be exerted on the material. In practice it is found that the differences in reactive forces alone can cause incomplete kiss cutting in portions of a cutting pattern.

Wear on the cutting blade is dependent upon the nature of the sheet material and the amount of preloading used. As wear increases higher preloading must be used in order to assure continued cutting. While wear is to be expected, the use of high loading forces not only accentuates the wear, but tends to decrease roller die life, because the number of the times that the blade can be resharpened (a conventional procedure) is also reduced.

The effective clearance also changes appreciably during operation because of thermal expansion, as the friction and forces exerted heat up the roller die from a cold starting state. Considering the size of the typical roller die and anvil, and the very small effective clearance range that is permissible, it is clear that only a small amount of thermal expansion will induce excessively high pressures.

There are limits on the pre-loading forces that can be applied. Because there is a constant tendency during usage of a roller die to increase preloading with time, die life may be shortened by this limitation alone. If initial clearance is too great or too small, moreover, preloading adjustments are of no benefit, and this is another limitation on present systems.

It is evident, therefore, that a substantial need exists for systems and methods that enable control of the parts of a rotary die system so as to make the required minute clearance adjustments at the cutting region in a manner which enables a minimum but suitable preloading force to be exerted. Because roller die modules are usually only a small part of a pre-existing rotary press, which may include printing, drying and other stations, any new systems and methods should be fully compatible with existing rotary press systems both in physical and economic terms. Moreover, it should be possible to make the necessary adjustments dynamically, with the system in operation.

SUMMARY OF THE INVENTION

Systems and methods in accordance with the invention provide an adjustable clearance based on the interrelationship between a geometrical displacement and a preloading displacement. Both adjustments are made at the bearers, utilizing contacting conical bearers that have a laterally adjustable relationship, and complementary angles. The geometrical clearance adjustment mechanism can be shifted in either direction within limits while preserving adequate bearer contact area for preloading. Changes in geometrical clearance alter the preloading forces, but compensating changes can also be made quickly during operation to bring loads into a predetermined range while also properly cutting the sheet material. A stabilized support structure which includes load sensing means is coupled to the preloading system and arranged to restrict deflections resulting from reactive forces to a very low level. The mechanism is fully compatible with die cutting station geometries in existing presses, and can thus be used interchangeably in commercial presses with prior art roller die and anvil combinations.

In a preferred system the bearers on each element have angles of inclination and are fixed, with the clearance being changed by changing the relative position between the die and anvil during operation. In a different exemplification at least one pair of bearers on an element are movable relative to the element and each other, so that separate adjustments may be made.

As an example, in at least one of the rotary die and anvil is laterally movable over a predetermined distance relative to the other, while maintaining parallelism in the gap region. The roller die and anvil each incorporate precisely spaced conical bearers of like angles of inclination, on opposite sides of the gap span in which the cutter blade is positioned. The bearer on one unit, preferably the anvil, is of greater width so that the length of bearer contact remains constant as adjustments are made. Pressure rollers are urged against the conical bearers from a virtually non-deflecting pressure bridge, to preload the die and anvil and alter the clearance by compression of the bearers within their yield limits. A lateral adjustment mechanism that is coupled into the support structures for at least one of the die or anvil enables axial shifting during rotation. The relative positions of the conical bearers can thereby be changed during operation to achieve a precise geometrically controlled displacement in the nominal blade tip-anvil surface clearance. Although bearer contact is maintained the geometrical clearance change alters the preloading forces and consequently affects the vertical position of both the rotary die and anvil. Thus if finer adjustments of geometry and preloading are needed, available load cell readings that indicate the force levels are used for reference. The effects on cutting are also observed as these changes are made. A balance can quickly be obtained in which the effective clearance and preload forces are set within predetermined ranges, despite dynamic reactive force changes, wear, and thermal expansion. By holding the preloading forces in a minimum acceptable range for many different operative conditions, die life is extended. The final stage of die usage is reached only when both geometrical and preloading adjustments approach out of range conditions.

In a more specific example of a system in accordance with the invention, a stable reference structure is provided by a low flex pressure bar having substantially less than 0.00005 inch deflection under the maximum pressures and forces exerted. The lateral adjustment mechanism is coupled to the anvil, the journals of which are seated at each end in bearings so as to be laterally movable. A manually rotatable handle is threadedly engaged in a fixed member coupled to the frame, and is connected to a bearing secured to one journal of the anvil. Turning the manually operable handle through a given angle thus varies the geometrical clearance by a predetermined amount.

Mechanisms in accordance with the invention for adjustment of geometrical clearance enable the anvil journals to be laterally slidable in bearing block mounts on each side of the anvil. An externally threaded hollow cylinder having an adjustment handle for operator control is seated in a sleeve that is fixed to the frame and contains needle bearings retaining the anvil journals. A roller bearing within the machine end of the cylinder is engaged by the cylinder structure and coupled to the anvil journal to allow lateral translation concurrent with rotation. With a selected thread pitch for a given angle of inclination on the conical bearers, a known angular adjustment results in a predetermined clearance change.

Methods in accordance with the invention utilize the dual interrelated adjustments of geometry and compression to maintain the preloading and net clearance within preselected ranges. Nominal conditions of clearance and preloading are established at the start, but both are adjusted dynamically during operation. As conditions change, or the pattern is not being properly cut, both factors are adjusted until the cutting action is satisfactory and the preloading force is at a given minimum level.

Where the reactive forces along cross-cutting lines are so high as to make preloading adjustments difficult, the path of the sheet material through the die cutting region may be angled slightly. This can be done, in a standard press by incorporation of angled guide bars prior to and after the die cutting station.

A different example of a system in accordance with the invention incorporates bearers which are individually adjustable on one of the rotary elements, such as the anvil. For this purpose the bearers may be engaged by a threaded coupling and held in place by mechanical restraint, such as lock nuts. The pair of bearers on each element may have like or opposite angles of inclination, and indicia may be used to provide references so that precise adjustments may be made while maintaining parallelism between the roller die and anvil. Adjustment during operation is not as readily feasible with this arrangement.

In another form of die cutting system in accordance with the invention the die comprises a magnetic cylinder to which a flexible wraparound sheet having hardened cutting blade patterns on its surface is affixed. Conical bearers preloaded from an external force are used for concurrent adjustment of clearance by varying compression and the relative positions of the bearers.

Systems and methods in accordance with the invention have the desired operative advantages, in that they not only greatly simplify the manufacturing process by allowing a more standard approach to geometrical clearance, but also substantially reduce the wear of the cutting blades, eliminate spalling of the bearer surfaces, and enable adjustments to be made in a versatile manner in response to changes in operating conditions, whether arising from thermal buildup, blade wear or properties of the material being cut.

BRIEF DESCRIPTION OF THE DRAWINGS

A better understanding of the invention may be had by reference to the following description, taken in conjunction with the accompanying drawings, in which:

FIG. 4 is a fragmentary view of a part of the mechanism of FIGS. 1–3, showing the relationship of bearers and cutting blade;

FIG. 8 is a diagrammatic representation of the relationship between the geometrical clearance and preload clearance;

FIG. 11 is a side sectional view of a different arrangement for control of bearer position to vary clearance; and FIG. 12 is a simplified perspective view of a die cutting system in accordance with the invention using a flexible die adhered to a magnetic cylinder.

DETAILED DESCRIPTION OF THE INVENTION

Figure 1:
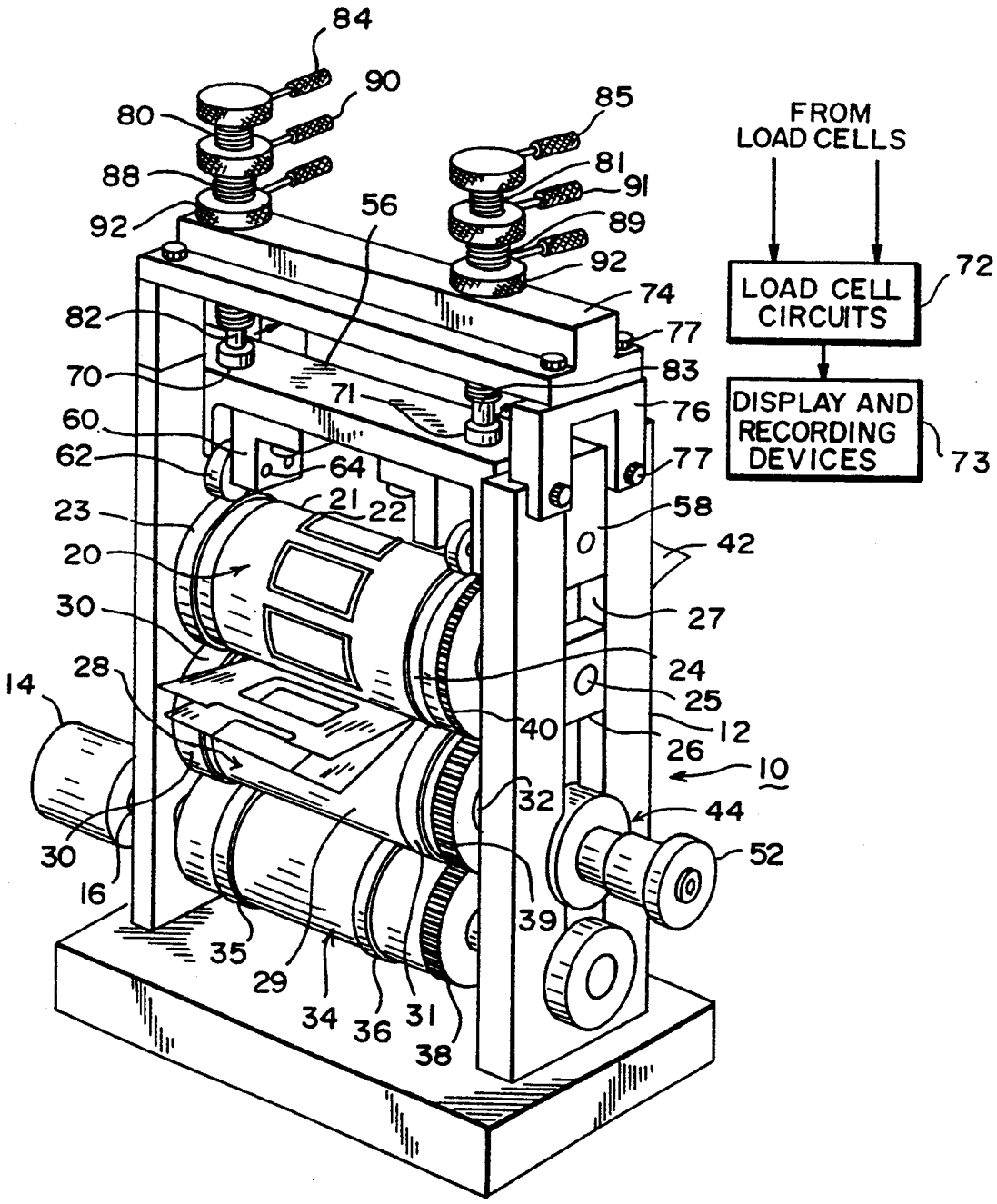
FIG. 1 is a perspective view, partially broken away, of a portion of a rotary press using a rotary die cutting system in accordance with the invention.
Figure 3:
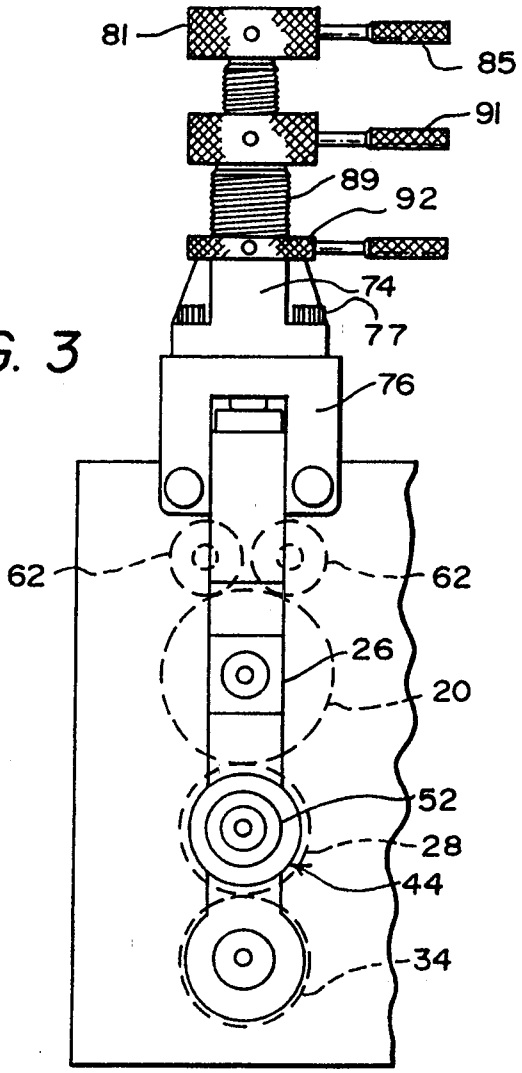
FIG. 3 is a side view of the mechanism of FIGS. 1 and 2.

Referring now to FIGS. 1–4, a portion of a rotary press 10 is shown that incorporates a die cutting station constructed in accordance with the invention. The press 10 typically accommodates six inch, twelve inch, and sixteen inch circumference die cutting units. The operative elements are principally mounted in an upstanding frame 12 adequately massive to withstand the forces involved without meaningful deflection. Presses that include rotary die modules, such as the Webtron "650" made by Webtron Corporation of Ft. Lauderdale, Fla., incorporate all of the necessary material supply, handling, tension control and other functions typically employed with printing stations, drying system and slitters. In this system, as in the Mark Andy "2100" system sold by Mark Andy Inc. of Chesterfield, Mo., the die cutting modules comprise three stations arranged serially and adjacent to each other. Support rolls may or may not be used, and underside die cutting is optionally employable. The systems may preload by pressure adjustments on the bearers, but use relatively light weight, deflectable bridge structures. In the present example, only a single die cutting station is shown for purposes of simplicity and clarity.

A drive motor 14 and a drive shaft 16 provide rotary power for a drive train described in more detail below. The rotary press 10 is usually mounted in an upstanding fashion, with the principal operative elements, such as the roller die 20, rotating about a horizontal axis that serves as a geometrical reference for the system. The die 20 has a central cylindrical body 21 concentric with the central axis, on the surface of which is disposed a protruding cutting blade 22 in a pattern or patterns defined by the shape that is to be cut. The pattern is usually of a closed loop form and has segments in the cross-cut and machine directions, and directions intermediate thereto. The patterns and orientations can be arbitrary and incremental blade lengths can lie at any angle or form part of a curvature. The die 20 also includes a pair of conical bearer surfaces 23, 24, concentric with the central axis and disposed at each end of the central cylindrical body 21. The bearers 23, 24 are described in greater detail below, but they have like angles of inclination and are spaced apart by a predetermined, precisely determined distance. The angles of inclination are low, typically less than 2°, so that they are best depicted in exaggerated form in FIGS. 4 and 8. Journal shafts 25 extend outwardly beyond the bearer surfaces 23, 24, the journals 25 here being seated in bearing blocks 26 which are slidably fit into vertical loading slots 27 in the upstanding frame 12.

Below the roller die 20 and concentric with a horizontal axis parallel to it is a rotary, laterally adjustable, anvil 28 having a cylindrical central region 29 opposing the cutting blade 22. A pair of bearer surfaces 30, 31 at the different ends of the central region 29 register in load bearing relationship with the bearer surfaces 23, 24 on the die 20. The anvil bearers 30, 31 are also conical and have like angles of inclination relative to the central axes. Also the bearers 30, 31 on the anvil are precisely spaced apart, in a predetermined relation to the spacing between the die bearers 23, 24, so that parallelism is maintained as the relative lateral positions are changed. Referring briefly to FIG. 8, this result can be achieved using a series of machining steps starting with defining bearer surfaces with precise but uniform diameters. The lateral positions are then defined by machining in side reference surfaces, e.g., **30*a*. Then the inclined surface can be machined in to ever increasing depth at the desired angle until a selected length of flat, e.g., 30*b*, remains at the corner with the side reference surface 30*a***. This approach positions the inclined bearers with exactness both along the longitudinal axis and in radial position.

Referring again to FIGS. 1–4, the bearer pairs 23, 24 and 30, 31 have radial dimensions relative to the cylindrical central region 29 such that, when centered, a given clearance exists between the tips of the cutting blades 22 and the cylindrical surface 29 of the anvil 28. The width of the anvil bearers 30, 31 along the longitudinal axes is greater than the die bearers 23, 24 so that full contact can be maintained. Journal shafts 32 on the anvil are seated in bearings retained in the vertical loading slots 27, below the bearing blocks 26 for the die 20. The journals 32 and anvil 28, however, are horizontally adjustable, as is described in more detail hereafter.

Figure 2:
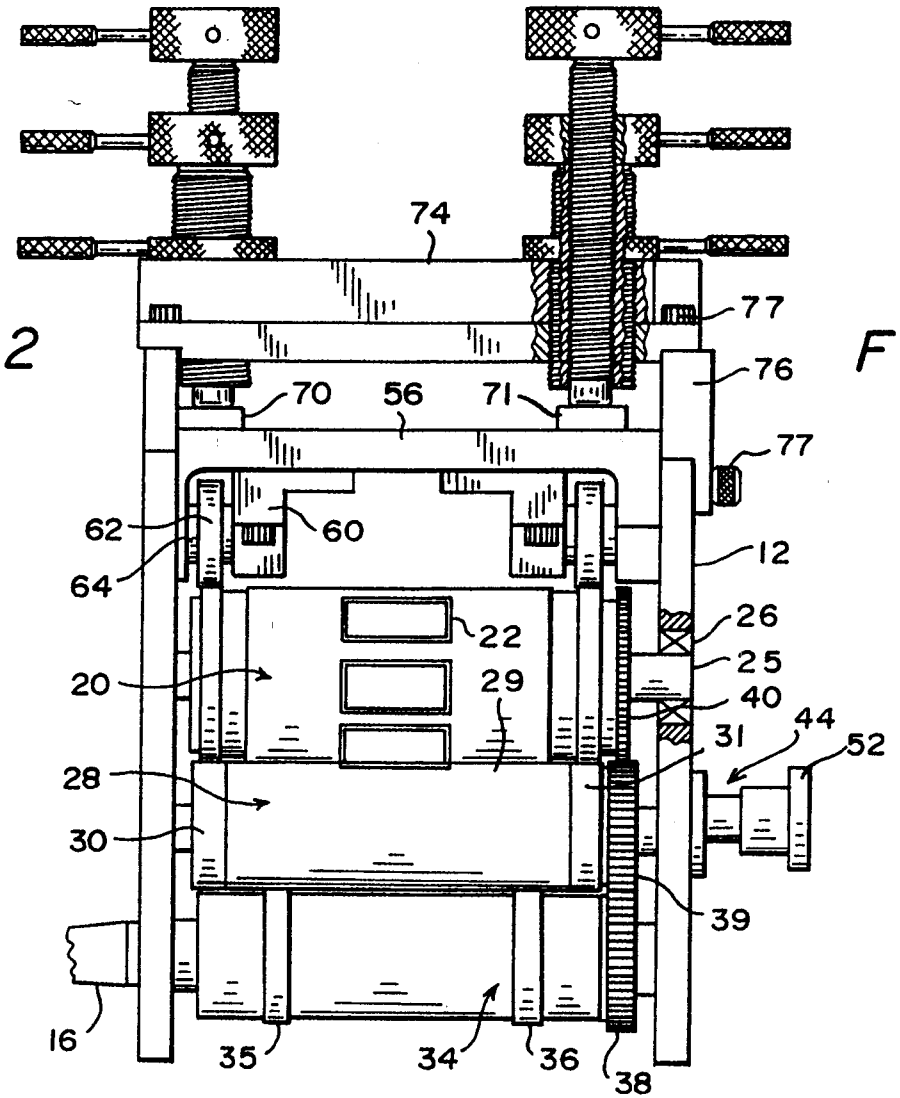
FIG. 2 is a front view of a portion of the mechanism of FIG. 1.

The cylindrical surface 29 of the anvil 28 in turn may engage facing surfaces on lower support roll 34, by engagement against flat bearer surfaces 35, 36 on the support roll 34, as best seen in FIGS. 1 and 2. The support roll 34 is coupled to and driven by the drive shaft 16 in the rotary press 10. A support or back-up roll is an optional feature for roller die modules.

At one end of the support roll 34, here at the opposite end from the drive shaft 16, a coupled drive gear 38 is concentric with the support roll central axis. Between the support roll 34 and the side frame 12 the drive gear 38 engages a superior driven gear 39 on the anvil 28, which in turn engages another driven gear 40 for the overlying roller die 20. The diameters of the driven gears 39, 40 mesh to rotate the roller die 20 and anvil 28 in synchronism.

Figure 5:
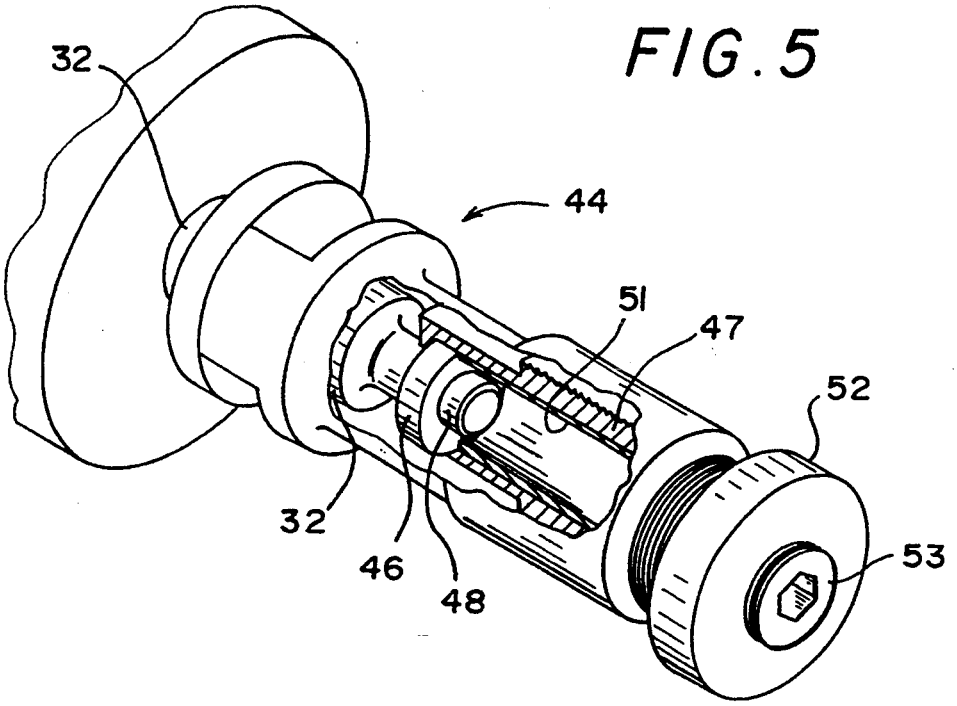
FIG. 5 is a perspective view, partially broken away, of the lateral adjustment mechanism for the roller die.
Figure 6:
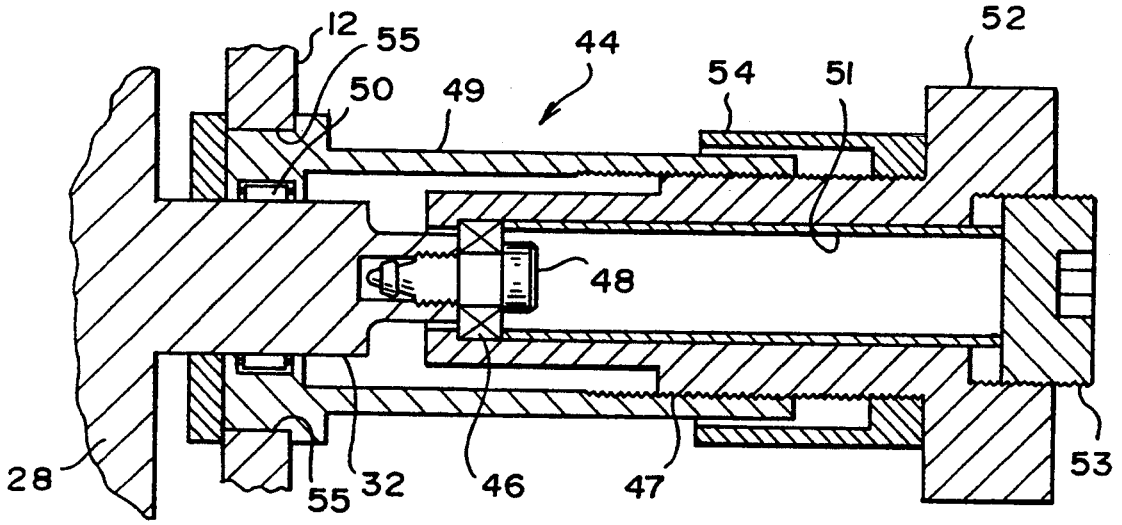
FIG. 6 is a side sectional view of the mechanism of FIG. 5.

The restraint for the anvil 28 is the slot 27 in the upstanding frame 12, but the anvil 28 and its journals 32 can be adjusted in the horizontal direction, along the central axis of the anvil, by a lateral adjustment device 44 which also provides bearing support. As seen in FIGS. 5 and 6, this device 44 includes a roller bearing 46 concentrically mounted within a cylindrical member 47 concentric with the anvil central axis. The inner diameter of the roller bearing 46 is seated between the end of the journal 32 and a shoulder bolt 48 that fits into the journal 32 end. The outer diameter of the bearing 46 fits against a shoulder in the cylinder 47 that limits movement of the bearing 46 toward the journal 32. The cylinder 47 is threadedly engaged to a sleeve 49 seated in the frame 12, with the thread profile having a given pitch. At the frame 12 the cylinder 47 includes a needle bearing 50 which registers with and receives the journal 32 and allows lateral movement. A similar needle bearing in the bearing block for the journal (not shown) for the anvil 28 may also be used to allow lateral shifting. The end of an internal tube 51 secured within the cylinder 47 presses the roller bearing 46 against the shoulder in the cylinder 47 so that the bearing 46 is secured and moves in and out with the cylinder 47, which is manually turned by an adjustment handle 52. The tube 51 is held in position by a plug 53 threaded into the handle 52. A cover sleeve 54 protects and encloses the external thread on the cylinder 47. At the frame 12, the base of the fixed sleeve 49 includes grooves 55 for slidably fitting into the slot 27 (not shown) of the frame 12. It will be appreciated that in FIGS. 5 and 6 the unit 44 is turned by 90° from its normal position, for clarity.

Above the roller die 20, referring again to FIGS. 1–4, is a horizontal pressure bar 56 having a substantially flat upper surface and substantial rigidity. The pressure bar 56 is slidable in the vertical loading slot 27 at depending side flanges 58. Spaced apart L angle braces 60 in the intermediate section of the pressure bar 56, together with the flanges 58, provide bearing support for pressure rollers 62. The pressure rollers 62 are mounted in paired fashion in the space between the side flanges 58 and L angle braces 60, being rotatably supported on relatively heavy shafts 64. The pressure rollers 62 are effectively alike on both sides, but the mountings are disposed in mirror image fashion. The pressure rollers 62 on either side of the roller die 20 engage the different bearers 23, 24 and thus are matingly conical in shape to exert distributed compressive forces.

A pair of load cells 70, 71 of conventional nature are disposed on the flat upper surface of the pressure bar 56, the load cells 70, 71 being substantially in alignment with the pressure rollers 62. Signal lines (FIG. 1 only) from the load cells 70, 71 connect to circuits 72 which drive a load display and recording devices 73 of analog or digital character, for indicating or recording, or both, the load forces. The compression and the compressive deflection may be computed, if desired, using the modulus of elasticity of the bearers and the surface area that is in contact.

The loading forces for this arrangement are exerted from a base structure defined by an overlying fixed horizontal bridge 74 of substantially massive construction, sufficiently rigid to undergo minimal deflection when loading forces are applied. It is preferred that the maximum deflection under any operative conditions be less than 0.0002". The horizontal bridge 74 is coupled to a riser block 76 that is removably secured to the upper portion of the frame 12 by large detachable screws 77.

Loading screws 80, 81 extending down through threaded apertures in the bridge 74 have piston ends 82, 83 respectively which engage the upper surfaces of the load cells 70, 71. Load screw handles 84, 85 at the upper ends of the loading screws 80, 81 may be manually adjusted to provide a selectable force or pressure, as described hereafter. The force is actually applied by turning the loading screws 80, 81 within associated retainer sleeves 88, 89 which mate with the threads (not shown) within the bridge 74. Handles 90, 91 respectively may be used to set the retainer sleeves 88, 89 into a given position in the bridge 74, this position being maintained by setting external lock nuts 92.

System Operation—A rotary die cutting system is a dynamically and cyclically varying mechanism, when operating at the levels of precision needed for critical kiss cutting or zero tolerance cutting operations. Even though the operative units are mounted in a relatively massive structure and comprise heavy bodies, errors in deflection or clearance of the order of a few ten thousandths of an inch are sufficient to result in improper cutting or in blade damage. The present system recognizes and accounts for these factors in a fashion superior to prior art systems.

The vertical loading slot 27 receives the support roll 34, anvil 28 and selected roller die 20 in such fashion that these units can be replaced with other sizes or with prior art combinations. The bearer surfaces 23, 24 of the roller die 20 rest on the bearer surfaces 30, 31 of the anvil 28. The central cylindrical portion 29 of the anvil 28 in turn rests on the bearer surfaces 35, 36 on the support roll 34, the support roll being seated on the bottom of the frame 12 in the press 10. There is no significant vertically oriented restraint imposed on the rotary elements at the end surfaces.

The drive shaft 16 directly connected to the support roll 34 and drive gear 38 rotates the driven gears 39, 40 and the respective die 20 and anvil 28 in synchronism with like peripheral velocities. Thus the sheet material 42 passing through remains in a linear path.

The sheet material 42 is typically at least a few thousandths of a inch (mils) thick, but it may vary widely in elasticity, resistance to shear, and other characteristics as well as thickness. The profile of the cutting blade 22 and the amount of instantaneous length of cutting blade in contact with the material (cross direction vs. machine direction cutting) also must be considered. These factors vary the clearance by introducing a reaction force against the roller die 20 that changes as the pattern is being cut. The initial clearance is preset, either in accordance with designer calculations, by using past experience, or by running trial samples and making adjustments accordingly. In kiss cutting, for example, an initial estimate can be made based upon the thickness of the substrate (which is not to be cut), and the top layer or layers (which are to be cut). It can be initially assumed that the laminate layer must be sheared approximately 75–90% through, with the thin remaining web then bursting under the shearing action and compressive forces exerted by the blade 22.

Figure 7:
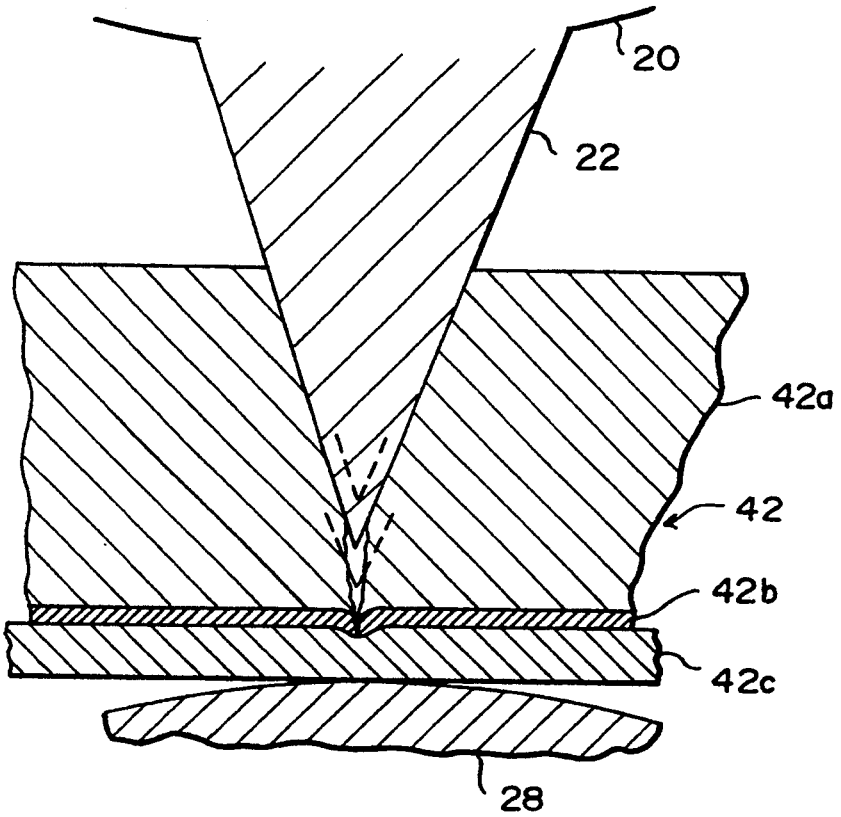
FIG. 7 is a simplified representation of the shearing and bursting action in relation to the cutting blade in a rotary die system.

FIG. 7 illustrates the shearing and bursting action in a typical kiss cutting operation on a sheet material 42 made up of a top sheet **42*a*, an adhesive layer 42*b* and a substrate 42*c*. The cutting blade 22 on the anvil 20 penetrates to a given nominal depth, as shown in solid lines, shearing and stressing the side walls thus formed in the sheet material 42*a*. Concurrently, the additional forces of compression of the underlying sheet material 42*a* and adhesive 42*b* burst the remaining thin fragments without fracturing the substrate 42*c*. On heating, the anvil may expand sufficiently to move the tip of the cutting blade 22 down enough to cut through the substrate 42*c*, as shown by dotted lines. The cyclic variations arising from reactive forces, however, can deflect the tip of the cutting blade 22** upwardly, as also shown by dotted lines.

With these factors as an initial criterion, the operator typically sets the compressive preloading force at a given minimal level, as seen in FIGS. 1–4 and 8. For precompression or preloading, the loading screws 80, 81 are turned until the load cells 70, 71 indicate a predetermined force, say about 100 lbs. (for a 6/" roller die), equally distributed in most instances (although not necessarily). This preloading affirmatively engages the roller die 20 into the substantially nondeflecting pressure loading system that includes the horizontal pressure bar 56 and the fixed overlying bridge 74, and reduces the clearance between the cutting blade 22 and anvil 28. The pressure bar 56 has less than about 0.0002 inches deflection under all circumstances for a given application, and typically substantially less. The force exerted is thus distributed through the elastic deformation of the bearer surfaces 23, 24 of the roller die 20, the bearer surfaces 30, 31 of the anvil 28 and down to the support roll structure 34. The support roll 34 is deflected downwardly slightly within the bearing blocks rigidly fixed in the frame 12 of the rotary press 10. The anvil 28 and roller die 20 may lower a small amount, comparable to deflection of the support roll 34, but because they move together there is no effect on the clearance once the preloading force has been established.

Figure 9:
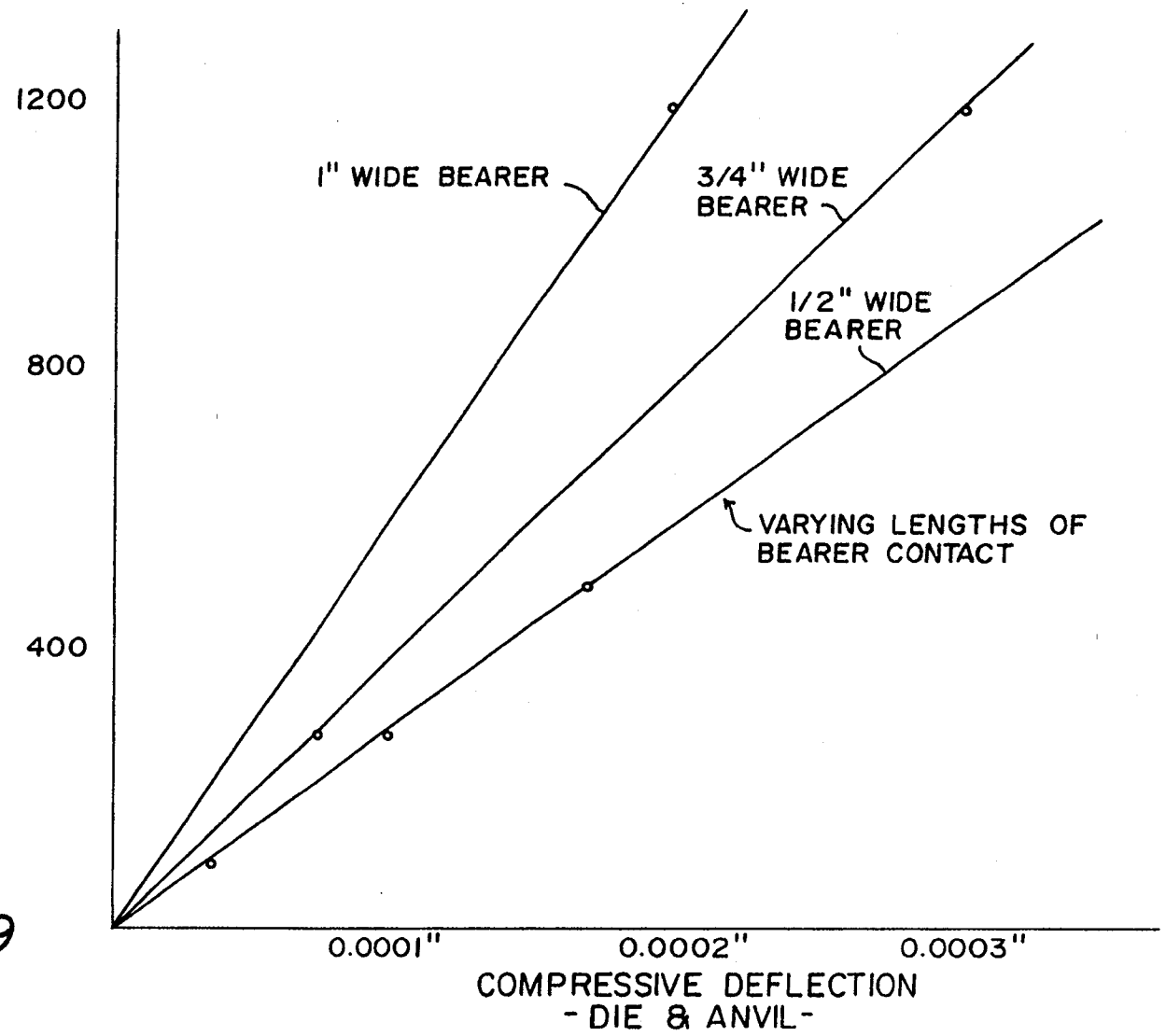
FIG. 9 is a graph of variations in deflection of different width bearers in relation to load.

As an additional starting adjustment, the anvil 28 may be shifted along its axis with the lateral adjustment device 44 to increase or decrease the clearance. If this is done the preloading force should usually be changed again to set it at the selected minimum level. Increasingly fine compensating adjustments may be made in the two parameters until final settings are reached. In practice, with a support roll system, it is typically found that a bearing pressure of 100 lbs. gives a deflection of 0.000035 inches, a bearing pressure of 300 lbs. gives a deflection of 0.00010 inches, and a bearing pressure of 500 lbs. gives a deflection of 0.00017 inches, for a six inch roller die with a one-half inch bearer. For a twelve inch roller die, with a three-quarter inch bearer surface, a load force of 300 lbs. gives 0.00007 inches, a load force of 500 lbs. gives 0.00012 inches and a load force of 700 lbs. gives 0.00017 inches. A sixteen inch die typically has a one inch bearer surface, and a load force of 400 lbs. gives a deflection of 0.00063 inches, a load force of 600 lbs. gives a deflection of 0.0001 inches, and a load force of 1,200 lbs. gives a deflection of 0.0002 inches. These relationships are illustrated diagrammatically in the chart of FIG. 9.

Operation of the system is predetermined in one respect, in that the die designer must utilize a roller die 20 that is of a diameter and material determined by the customer in accordance with economic considerations. The reactive force introduced by the cutting blade 22 thus tends to deflect a smaller roller die (i.e. 6" circumference) substantially more than the larger die (i.e. 16" circumference), a factor which must be accepted. The extent of deflection also varies with die construction, processing and material used. A tool steel that is of high chrome content and through hardened, is substantially stiffer than other materials, and preferred for "zero tolerance" and kiss cutting operations.

The geometrical clearance adjustment of the space between the cutting blade 22 tip and the surface of the anvil 28 is readily equated to the handle 52 angular position. Because the bearer angle is selectable and a given thread pitch is used, an adjustment of one full turn of the handle 52 causes a known change in vertical displacement, as of 0.001 inches for convenience. The bidirectional capability afforded by this adjustment allows the blade to perform within its elastic limit for zero clearance cutting, and to be precisely placed for kiss cutting, both with low, acceptable preload forces.

Precise adjustment for satisfactory cuts with difficult sheet material 42 is usually made by running the system on a trial or continuous basis. If the cut into the material is too deep in a kiss cutting application, so that the substrate is severed or substantially marked, the geometric clearance and preloading clearance may concurrently be adjusted to bring the values within predetermined limits.

Starting with a "cold" machine, before the thermal energy expended during the work of the sheet material 42 has caused heat buildup in the die 20 and anvil 28, the clearance is gradually reduced as these elements expand substantially. Again, the lateral adjustment device 46 and the loading screws 80, 81, are interactively adjusted to maintain the desired conditions, until the temperature level stabilizes. Subsequent to this, during a long run of material, only gradual adjustments need be made to compensate for blade wear with time. In kiss cutting operations, initial compensation for blade wear can be made by adjustment of the geometric clearance, while maintaining the applied force at the lower level of the acceptable range. After the geometric clearance has been carried to its acceptable minimal limit, further reductions in clearance to compensate for blade wear can be made by increasing the applied preloading force until this force also reaches a limit.

Adjustment of clearance by using geometrical displacement and precompression involves an interplay between a substantial number of factors. Referring now to FIGS. 4 and 8, the bearers 23, 24 and 30, 31 on the roller die 20 and the laterally movable anvil 28 are shown in solid lines as located at a nominal or design position. At this position, the clearance between the tip of the cutting blade 22 and the surface of the anvil 28 can be varied by compression by changing the preloading. It is to be noted,. however, that the loading exerted on the roller die bearers 23, 24 compresses both such bearer and the anvil bearers 30, 31 by substantially equal amounts. This means, therefore, that the downward displacement of the roller die 20 is added to the downward displacement of the anvil 28, it being assumed that the support roll 34 is substantially nondeflecting. The bearers 23, 24 and 30, 31 are deformed within their elastic limits to an extent determined by the load.

As noted above, for a one-half inch wide bearer in full contact 100 lbs. of force causes a change in displacement of approximately 0.000035 inches. Because total deformation is taken up in both bearers the surface of the roller die 20 moves twice as far downward than the surface of the anvil 28, so that the change in clearance is one-half the change in displacement of the roller die. These positions are shown by the dot-dash lines in FIG. 8.

Reaction forces induced by the action of the cutting blade 22 on a sheet 42 passing between the roller die 20 and anvil 28 act in opposite directions on the two elements. At the roller die 20, the reaction forces act upwardly, opposing the preload and thus opposing some of the preload force exerted by the roller die bearers 23, 24 on the anvil bearers 30, 31. Concurrently, however, the reaction forces act downwardly on the anvil 28, so that the preload on the bearer is, momentarily at least, augmented by a downwardly directed force in the interior region 29 of the anvil 28. The amount of reaction force varies dynamically, dependent on whether the cutting blade 22 at that instant follows a dominant machine direction vector or a cross direction vector. In a severe case, as seen at the dotted line in FIG. 8, the roller die 20 is momentarily forced up past its nominal position. The reaction force peak also depends upon the shape of the blade. If the blade 22 is new and properly sharpened, and the instantaneous cut is in the machine direction, the reaction forces will be at a minimum. A dull blade and a long cross direction cut creates the maximum reaction force characteristic.

The capability that the present system affords for adjusting geometric clearance enables the load resulting from the average reactive force summed with the loading force to be held at a predetermined level. The peak force exerted also can be limited, and typically will be something meaningfully below the elastic limit of the material. It is desired to limit the deflection resulting from reaction forces to less than about 0.000035".

The cutting action not only tends to oppose the preloading with a reaction force, but also introduces central radial force vectors that tend to bend the roller die 20 and anvil 28 to a small extent. The amount of bending is dependent on a substantial number of factors related to the size, material and hardening characteristics used with the roller die and anvil. A larger circumference roller die, for example, bends less than a smaller one, and a through hardened die bends less than a case hardened one, while a more expensive chrome alloy structure is more rigid than a carbon steel structure. Because the system deals with minutely varying but very significant clearances which change dynamically with blade attitude and the amount of blade in instantaneous contact during rotation, substantial changes in operation and in cutting efficiency can be seen, in practice as well as in theory.

Any change in geometrical displacement changes the amount of preloading as well. If the clearance is increased geometrically, as shown by the dotted line position to the left in FIG. 8, this inherently increases preloading forces, so that preloading must be reduced back to the level or range that is desired. Several adjustments of this kind may be needed in order to achieve a final condition in which the cutting operation is satisfactory but the preloading is set at a minimum load range, typically 100 lbs. for a 6" roller die to 300 lbs. for a 16 inch roller die. Satisfactory cutting together with minimum load pressure are the two criteria that are observed in compensating for changes in cutting blade wear and in thermal expansion of the system parts. Maintaining the preload forces in the minimum range assures that the elastic deformation limits are not exceeded, while also limiting bearer galling and wear. At the same time, the cutting blade can be resharpened more times, increasing the effective life of the roller die.

Figure 10:
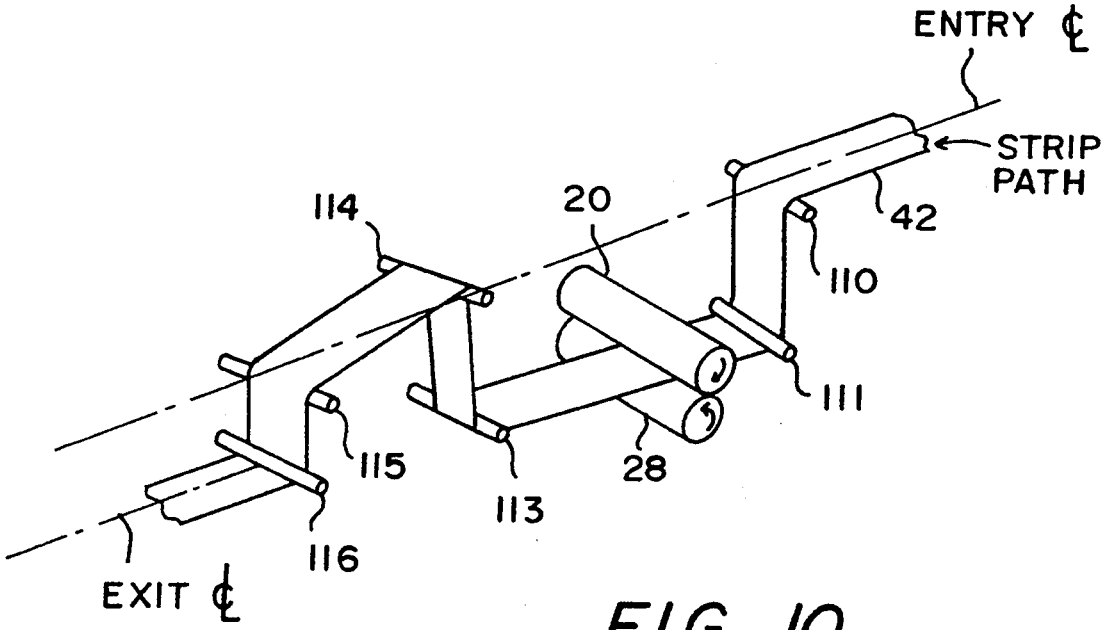
FIG. 10 is a perspective view of a portion of an arrangement for feeding sheet material through a die cutting station at a slight angle relative to the machine direction.

In some instances the differential in reactive force between cross-direction and machine-direction cutting may be so large, considering other conditions, that reliable kiss cutting may not be feasible. When this condition arises the loading and geometrical adjustments may be brought back into range by angling the strip being cut slightly as it passes through the cutting zone. As depicted in simplified form in FIG. 10, the angle of the path between the roller die 20 and anvil 28 can be changed by wrapping the strip 42 of sheet material around sets of fixed or roller guides. At the feed side the strip is wrapped around a first guide 110, which may have edge shoulders to limit any tendency to drift parallel to the path of movement to a skewed second guide 111. At the second guide 111 the path direction is changed through a slight angle, typically less than 5°, which is maintained through the roller die 20 and anvil 28 zone. Thus a blade segment lying precisely in the cross-machine direction becomes slightly angled, and the reactive peak is greatly reduced.

At the exit side the strip 42 direction is returned toward the machine path by third and fourth skewed guides 113, 114. When the machine path is reached, a third guide pair comprising a skewed fifth guide 115 and a transversely positioned sixth guide 116 return the strip to the machine path, so that the exit centerline is parallel to the entry centerline.

A different exemplification of a system in accordance with the invention, as shown in FIG. 11, employs a pair of oppositely angled conical bearers on each of the die and anvil, at least one pair being individually adjustable. The anvil 20 has cutting blades 22 disposed on the cylindrical portion of its surface, as previously described. The journal mount and gear drive for the die 20 and the associated anvil 128 are as previously described, and this description therefore need not be repeated. The bearers 123, 124 on the die 20 are, however, oppositely inclined, the angle here being substantially exaggerated for ease of understanding, as is the spacing between the cutting blade 22 and the cylindrical surface 129 of the anvil 128. Bearers 130, 131 on the anvil 128 are substantially wider than the die bearers 123, 124, respectively against which they engage, so as to permit lateral adjustment while maintaining full contact. The adjustment is effected, however, by turning the bearers 130, 131 on mating surface threads 134, 135 on the anvil 128. Each bearer 130, 131 is secured against change of position by one or more adjacent lock nuts 138, 139 respectively. At the drive gear 39 side, the gear is 38 removable, being mounted on an insertable end shaft 142 fitting within a bore 144 in the end of the anvil 128. An intermediate flange 146 on the shaft 142 retains the gear 39 against the anvil 128, as retaining bolts 148 are threaded through the flange 146 and the gear 39 into the end of the anvil 128.

The arrangement of FIG. 11 utilizes separate adjustment of the anvil bearers 130, 131, relative to each other and to the respective bearers 123, 124 on the roller die 20. Because the anvil bearers 130, 131 have surfaces with opposite angles of inclination the forces exerted by the roller die bearers 123, 124 urge them in opposite directions, in this instance outwardly from the center region of the anvil 128, against the lock nuts 138, 139.

The arrangement as shown does not permit adjustment during operation, although it will be appreciated that a mechanism could be provided for this purpose. Typically, when an adjustment is to be made, the loading pressure must be relieved, and the roller die 20 sufficiently released so that the lock nut pairs 130, 138 and the bearers 130, 131 can be moved laterally relative to the length of the anvil 128. As previously mentioned in conjunction with the system of FIG. 1, the pitch of the threads 134, 135 can be selected relative to the surface angle on the bearers 130, 131 to provide a predetermined amount of change in clearance for a given amount of angular rotation of the individual bearer 130 or 131 relative to the anvil 128 body. Visible indicia may be marked on the anvil 128 to provide a reference against which the lateral shifts may be measured. Care should be taken to insure in the normal instance that the necessary degree of parallelism between the roller die 20 and the anvil 128 is maintained. In some instances, however, the ability to introduce a slight non-parallelism may aid in cutting asymmetric patterns.

A different type of die cutting system using the concepts of the invention is characterized by cutting blade patterns formed into a magnetic base sheet that is adhered to a magnetized cylinder about which it is wrapped. The blade formation process usually employs chemical etching of an initial plate, to reduce it to a wrappable base sheet having a protruding cutting blade pattern. This die cutting approach is variously referred to as using flexible dies, magnetic dies, wraparound dies or plate dies, the member to which the dies are attached being called the magnetic cylinder.

As seen in the simplified perspective view of FIG. 12, there is a close parallel to the previously described system, apart from the wraparound die sheet and the underlying magnetic cylinder structure. The drive, frame and bearing block portions of the unit have not been shown inasmuch as they need not depart from the system of FIG. 1, and the pressure roller system has been simplified for clarity inasmuch as it can be conventional.

The magnetic cylinder 150 and anvil 152 are disposed with conical cylinder bearers 154, 155 and conical anvil bearers 157, 158 in contact. As above, the anvil bearers 157, 158 are of greater width than the cylinder bearers 154, 155, and the anvil 152 is movable along its longitudinal axis during operation by a lateral position control 160. The angles of the conical bearer pairs 154, 155 and 157, 158 are again preferably less than about 2", since the clearance adjustments that are needed are again very small.

The surface of the magnetic cylinder 150 includes a matrix of embedded magnetic elements 162 around its periphery and along most of its length between the bearers 154, 155. The wraparound sheet 166, shown as only partially encompassing the cylinder 150 for ease of understanding, has a thin backing 168 from which hardened cutting blade 170 patterns protrude.

The sheet or strip material to be cut is passed between the wraparound sheet 166 and the surface of the anvil 152 to be cut into patterns defined by the blades 170. Pressure rollers 174, 175 acting on the magnetic cylinder bearers 154, 155 are used for the variable compression adjustment of clearance. The geometrical clearance adjustments are afforded by shifting the relative positions of the bearer pairs using the lateral position control 160. Consequently, adjustments can be made to keep preloading forces and clearance within the ranges needed for reliable cutting and long term operation.

The invention is also applicable to other rotary impression systems where forces vary with time in a long term manner, or cyclically, or both. If relatively large parts must rotate with a very precise clearance between them that must be adjusted dynamically, the geometrical and compression variations facilitated by the present invention may be of benefit.

It will be understood that, although a number of forms and variations have been described, the invention is not limited thereto but encompasses all alternatives and modifications within the scope of the appended claims.

What is claimed is:

1. A method of cutting sheet material in a rotary die system, said method including the steps of:

providing a roller die having a cutting blade protruding from a surface of said roller die;

locating conical roller die bearer surfaces having first angles of inclination on first and second ends of said roller die;

supporting said roller die for rotation about a roller die axis of rotation;

providing an anvil roller having a cylindrical central surface region;

locating conical anvil roller bearer surfaces having a second angle of inclination equal to said first angle of inclination on first and second ends of said anvil roller;

supporting said anvil roller for rotation about a fixed anvil roller axis-of rotation parallel to said roller die axis of rotation and for lateral shifting along said anvil roller axis of rotation with said roller die bearer surfaces engaging said anvil roller bearer surfaces;

providing an adjustable clearance gap between said cutting blade and said anvil roller central region;

positioning a substantially non-deflecting body generally adjacent said roller die;

applying adjustable external compressive loading forces to said roller die bearer surfaces from said non-deflecting body to adjustably elastically deform said roller die bearer surfaces and said anvil roller bearer surfaces;

setting a predetermined initial clearance gap by laterally shifting said anvil roller with respect to said roller die;

passing a sheet of material to be cut through said initially set clearance gap between said roller die and said anvil roller;

measuring said adjustable external compressive loading forces applied to said roller die bearer surfaces during said cutting of said sheet material;

generating changing reactive forces on said roller die and said anvil roller in response to contacting of said sheet of material by said cutting blade; and controlling said clearance gap in response to said changing reactive forces exerted on said roller die and said anvil roller by adjusting said lateral position of said anvil roller with respect to said roller die and by cooperatively adjusting said external compressive loading forces exerted on said roller die bearer surfaces from said non-deflecting body to thereby elastically deform said bearer surfaces of said roller die and said anvil roller for maintaining said clearance gap and said compressive loading forces within preselected ranges and thereby holding said reactive forces and said loading forces at any point in said cutting of said sheet material below a predetermined value while maintaining proper cutting of said sheet of material.

* * * * *